United States Patent [19]

Enzo

[11] Patent Number: 4,604,764

[45] Date of Patent: Aug. 12, 1986

[54] TAP FOR THE DELIVERY OF LIQUIDS FOR THE CONVERSION FROM AUTOMATIC TO MANUAL

[76] Inventor: Fava Enzo, 5, Via Simboli, 62019 Recanati, Italy

[21] Appl. No.: 661,858

[22] Filed: Oct. 18, 1984

[30] Foreign Application Priority Data

Oct. 3, 1984 [IT] Italy ..... 48941 A/84

[51] Int. Cl.[4] ..... E03C 1/05

[52] U.S. Cl. ..... 4/623; 4/191; 4/304; 4/305; 4/DIG. 3; 4/406

[58] Field of Search ..... 4/623, 191, 192, DIG. 3, 4/302, 303, 304, 406, 305

[56] References Cited

U.S. PATENT DOCUMENTS

| | | | |
|---|---|---|---|
| 3,491,381 | 1/1970 | Cathcart | 4/623 |
| 3,585,652 | 6/1971 | Forbes et al. | 4/623 |
| 3,585,653 | 6/1971 | Forbes et al. | 4/623 |
| 3,613,124 | 10/1971 | Ichimori et al. | 4/623 |
| 3,639,920 | 2/1972 | Griffin et al. | 4/623 |
| 3,724,001 | 4/1973 | Ichimori et al. | 4/623 |
| 4,398,310 | 8/1983 | Lienhard | 4/623 |

*Primary Examiner*—Henry K. Artis

*Attorney, Agent, or Firm*—Beveridge, DeGrandi & Weilacher

[57] ABSTRACT

A fluid delivery system can be alternately manually or automatically controlled. The system comprises a body for directing fluid to a desired location. Means for supplying fluid to the body are also provided. A regulator manually controls the flow of fluid through the body. A releasable lock secures the regulator in an open position so that fluid can flow through the body. An electrically operated valve in the fluid supply has an automatically controlled fluid flow circuit and a manually controlled fluid flow circuit. Sensing means detect the presence of an object proximate the body and provide an electrical signal in response thereto. A controller is provided for opening and closing the valve. Transmitting means transmit the electrical signal from the sensor to the controller for opening the automatically controlled fluid flow circuit in the valve. When the manually controlled fluid flow circuit in the valve is closed, the lock for the regulator is engaged. On the other hand, the lock is released when the manually controlled fluid flow circuit in the valve is open. The fluid delivery system is useful in combination with wash basins.

10 Claims, 7 Drawing Figures

TAP FOR THE DELIVERY OF LIQUIDS FOR THE CONVERSION FROM AUTOMATIC TO MANUAL

BACKGROUND OF THE INVENTION

This invention relates to a tap for the delivery of water or other liquids, and in particular to a tap that can be converted from automatic to manual operation.

Automatic taps provided with a sensor are known in the art and are particularly useful in sanitary services. The sensor consists of an emitter or receiver of infrared or visible rays, or any other device for surveying a space for the presence of bodies, such as a person's hands placed in a wash basin on which the tap is mounted. When the hands are placed into the wash basin near the water outlet, the tap operates by means of an electronic circuit and an electronic valve without manual intervention or an opening handle. The operation of automatic taps of this type are subject to interruption in the event of an electronic or electromechanical break-down or a black-out of electric current. This results in considerable inconvenience to the user.

It is an object of this invention to provide a tap that is automatically operable and which can be easily converted to manual operation in the event of damage to the tap or electrical black-out.

SUMMARY OF THE INVENTION

This invention provides a tap with electronic and electromechanical components in which a bypass operated by an electronic valve is provided, and in which a water opening and closing mechanism that will not be used during normal automatic operation is provided. The opening and closing mechanism can be in a warm and cold water mixer.

More particularly, this invention provides a fluid delivery system, which can be alternately manually or automatically controlled. The fluid delivery system comprises a body for directing fluid to a desired location. Means for supplying fluid to the body are provided. Also provided are regulator means for manually controlling flow of fluid through the body. Locking means for releasably locking the regulator means in an open position so that fluid can flow through the body are included in the fluid delivery system. An electrically operated valve means in the fluid supply means is comprised of an automatically controlled fluid flow circuit and a manually controlled fluid flow circuit. Sensor means for detecting the presence of an object proximate the body and for providing an electrical signal in response thereto are included in the system. Controller means regulates opening and closing of the valve. Means are provided for transmitting the electrical signal from the sensing means to the controller for opening the automatically controlled fluid flow circuit in the valve. The locking means for the regulator is engaged when the manually controlled fluid flow circuit in the valve is closed. On the other hand, the locking means is released when the manually controlled fluid flow circuit in the valve is open.

In the event of damage of an electronic or electromechanical component in the system, the locking means for the regulator may be released and the by-pass of the electronic valve may be opened by a key, screwdriver or similar device, thereby transforming the automatically operated tap to a traditional tap without the need of electronic and electromechanical parts.

BRIEF DESCRIPTION OF THE DRAWINGS

This invention will be described in more detail with reference to the Figures in which some possible embodiments of the invention are shown, and wherein:

With reference to FIG. 1, a fluid delivery system of the invention for delivering liquids is depicted. The delivery system can be converted from automatic to manual operation. The fluid delivery system is provided on a wash basin 4, and the system comprises a mixing handle 1, body 2, electronic sensor 3, electric cable 5, water conduit 6, electronic valve 7 having a water regulation handle 8 on a capacity regulator 9, and an electronic circuit 10 with a transformer 11.

According to the present invention, unscrewing screw A results in a by-pass in electronic valve 7, which allows the water entering electronic valve 7 to freely flow towards body 2 of the tap. Unscrewing screw B on the mixer handle 1 permits upward movement of the handle, which stops the flow of water through the body 2.

In all of the embodiments of FIGS. 2, 3, 4 and 5, the electronic valve is shown in a deenergized state in which the water does not flow.

During automatic functioning of the fluid delivery system, if bobbin F is tensioned, a pin or small piston M moves to the left thereby opening hole C. The water in chamber D freely flows through hole C toward the outlet and the pressure in chamber D diminishes with respect to the pressure in chamber E. This results in membrane F moving to the left in the Figures thus opening outlet G. All the water entering the inlet then freely passes from chamber E to the outlet through hole G.

Figure 1:
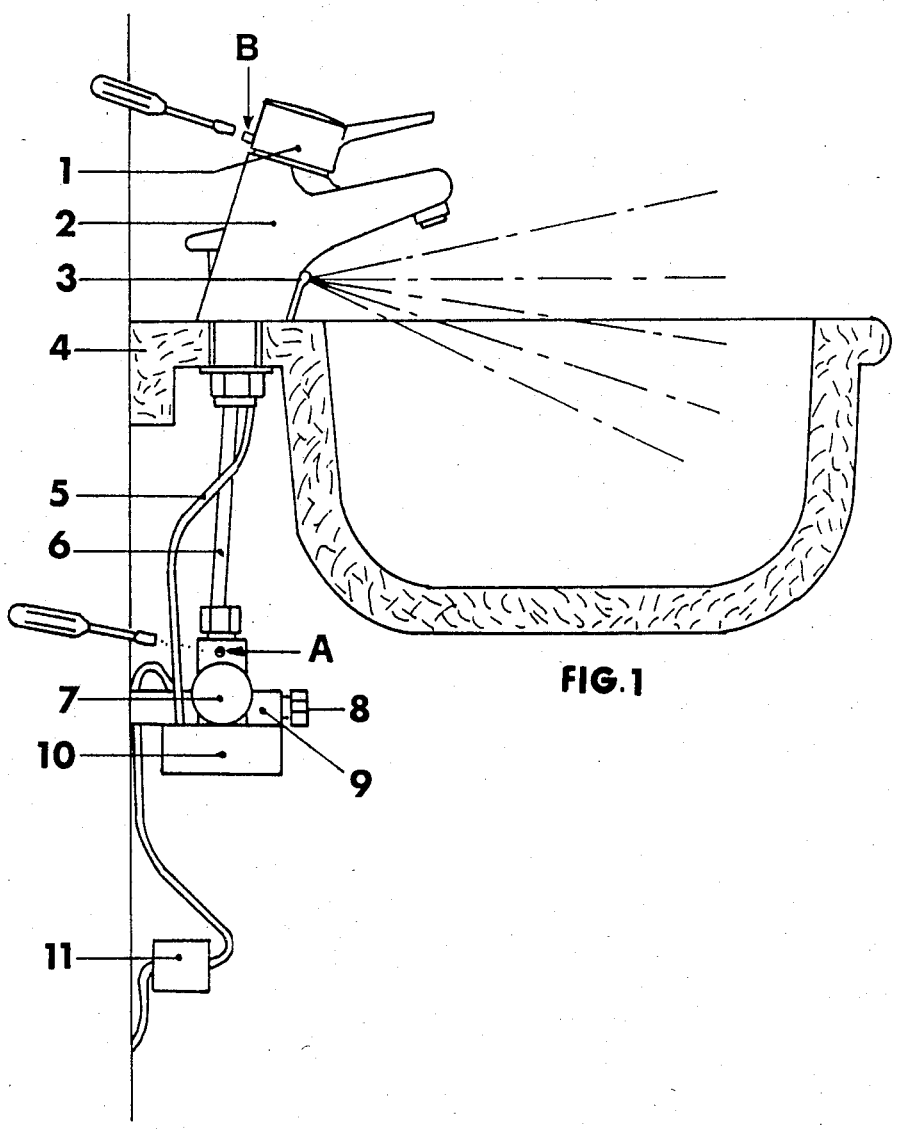
FIG. 1 shows the layout of an automatic tap with an electronic valve and with points A and B, which can be adjusted for converting the tap from automatic to manual operation.
Figure 2:
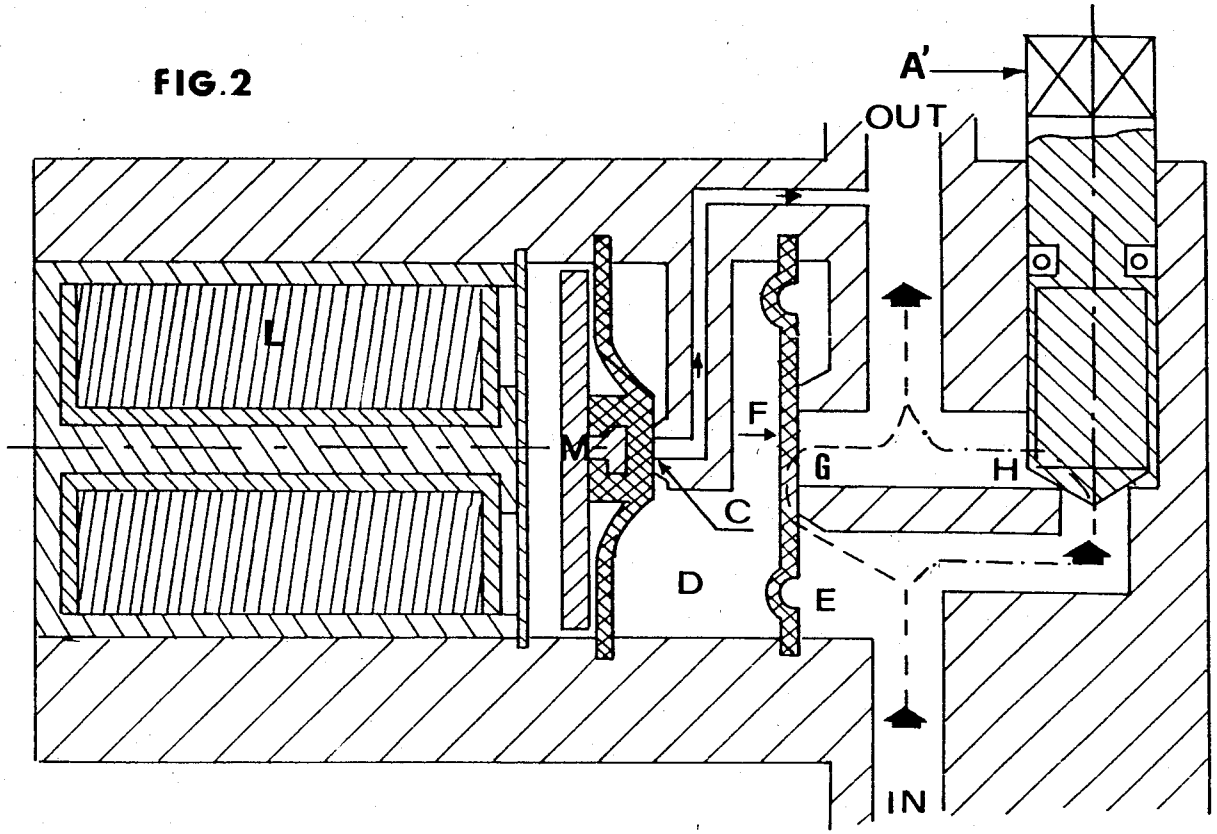
FIG. 2 depicts a tap with an electronic valve in which a direct by-pass is obtained by unscrewing screw A'.

In the embodiment shown in FIG. 2, unscrewing the screw A' results in a continuous functioning of the electronic valve due to the opening of hole H. All the water entering the inlet flows directly to the outlet through hole H.

In the Figures, the dashed lines show the flow of water when the electronic valve is energized and the membrane F is open. The alternate dash-dot line shows the flow of water when the manual by-pass is being employed.

Figure 3:
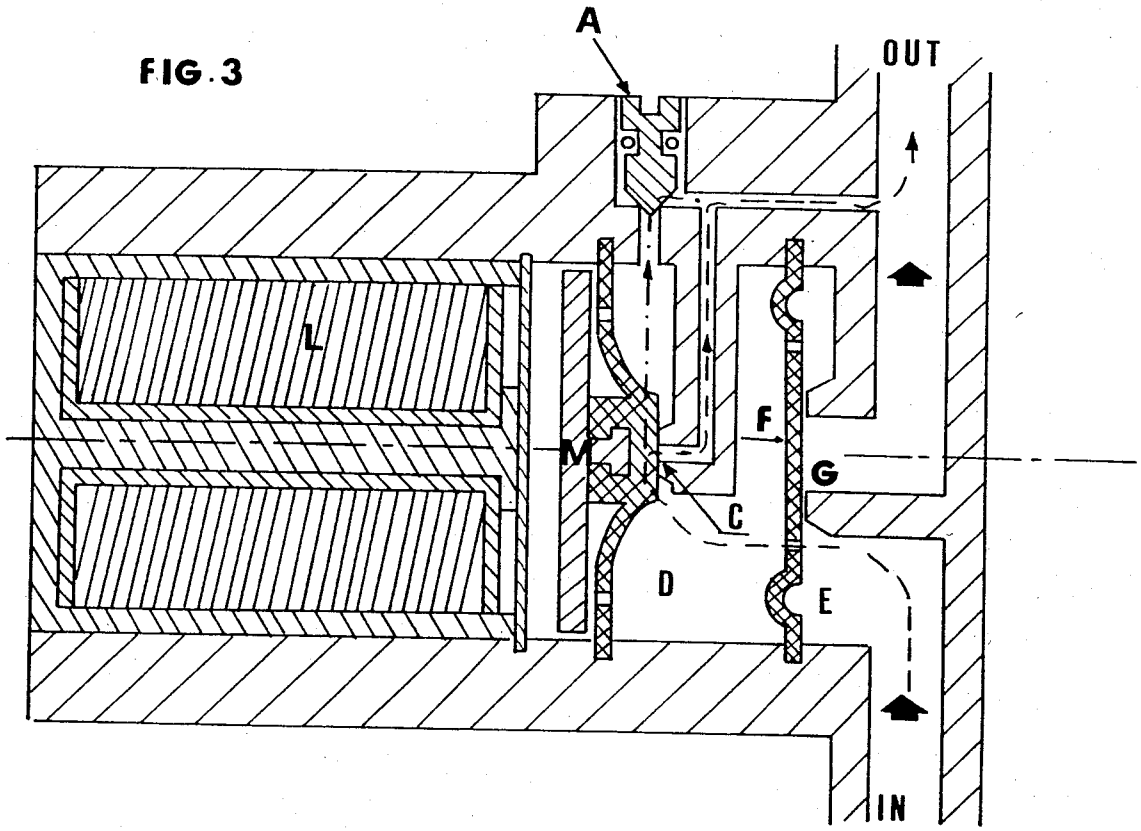
FIG. 3 shows the same scheme of FIG. 2 with an electronic valve in which a by-pass on a servo control causes the continuous opening of the electronic valve by unscrewing screw A.
Figure 4:
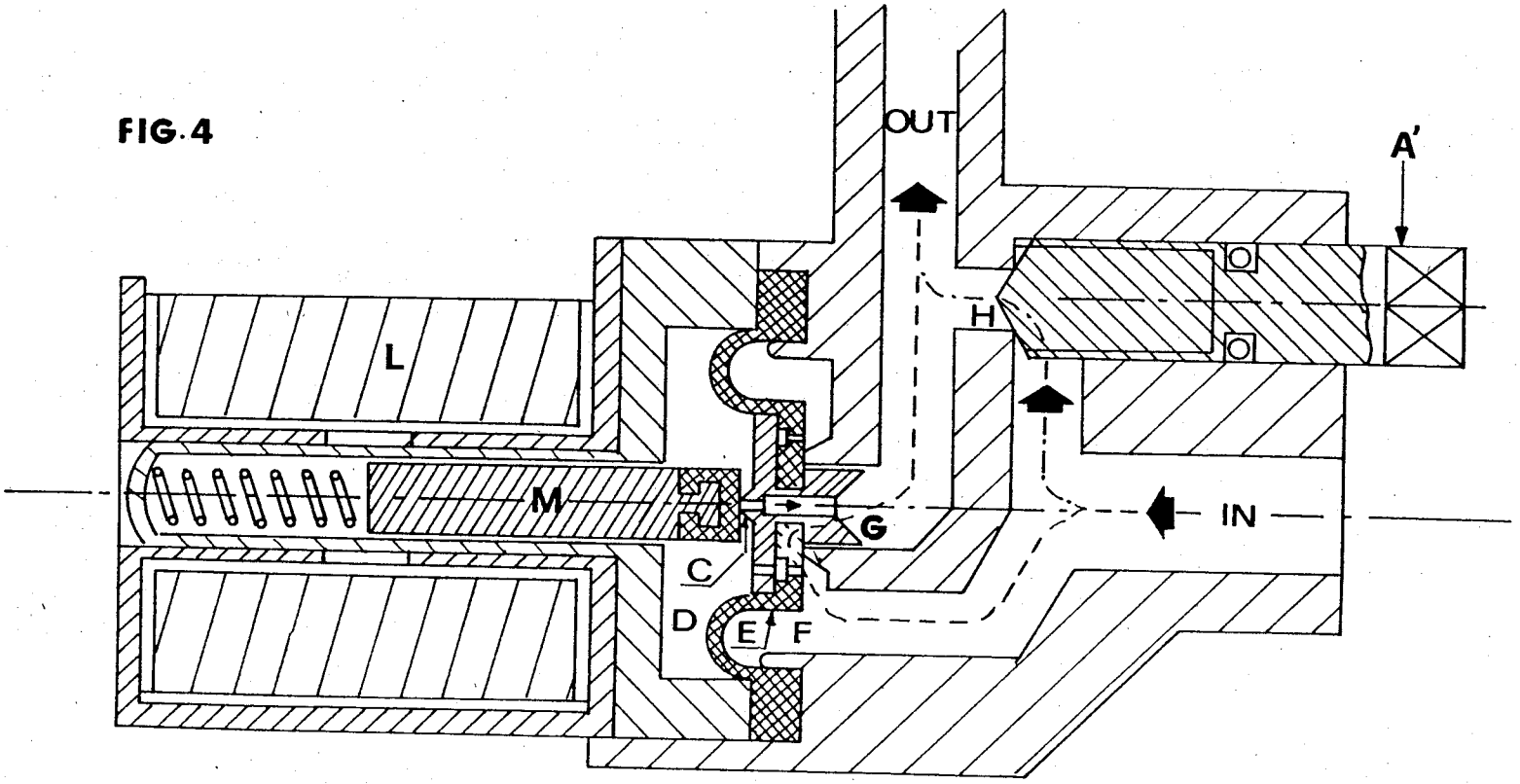
FIG. 4 depicts another embodiment with an electronic valve in which a direct by-pass is obtained by unscrewing screw A'.
Figure 5:
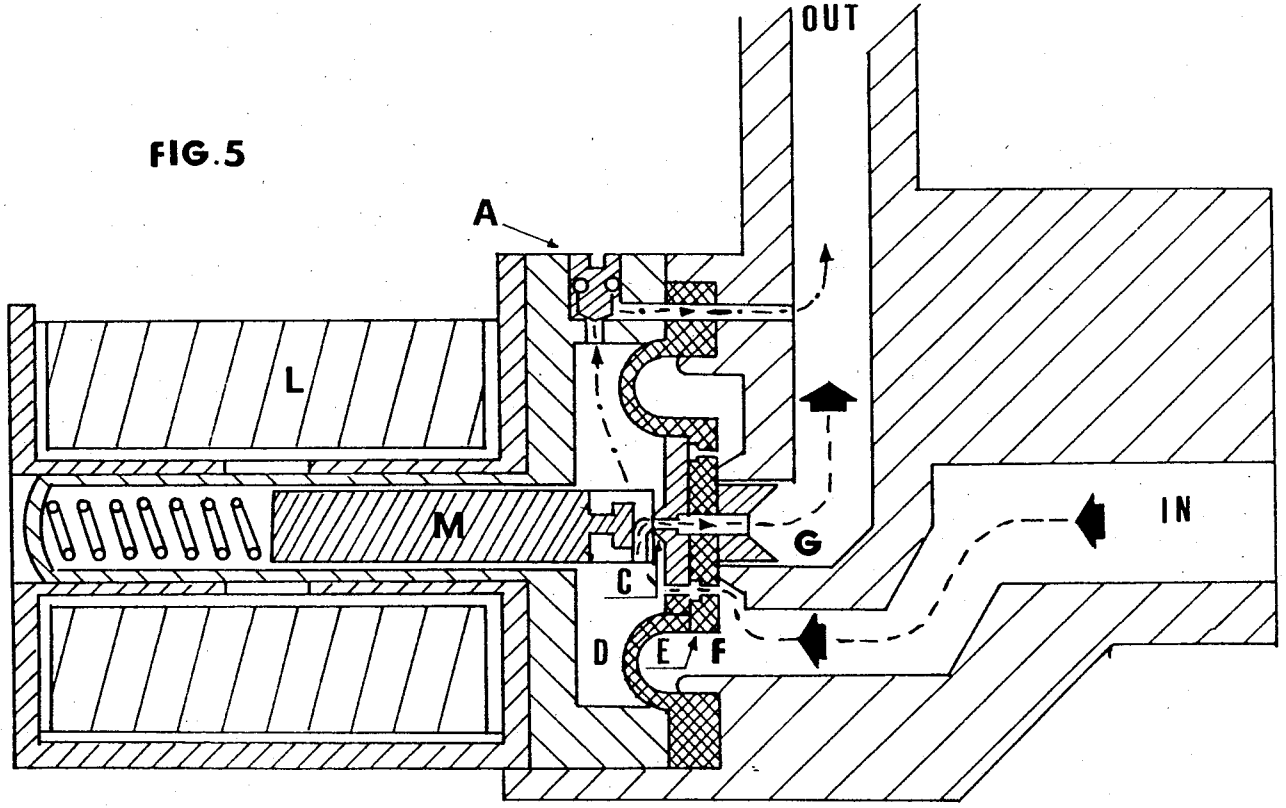
FIG. 5 depicts the same electronic valve scheme of FIG. 4 in which a by-pass on the servo control causes the continuous opening of the electronic valve by unscrewing screw A.

In the embodiment shown in FIG. 3, unscrewing screw A results in continuous functioning of the electronic valve so that water in chamber D freely flows through the manual by-pass, and the pressure in chamber D is diminished with respect to the pressure in chamber E. This results in membrane F being moved to the left, thus opening outlet hole G. The direction of water flow is shown with broken lines as in FIG. 2.

Figure 6:
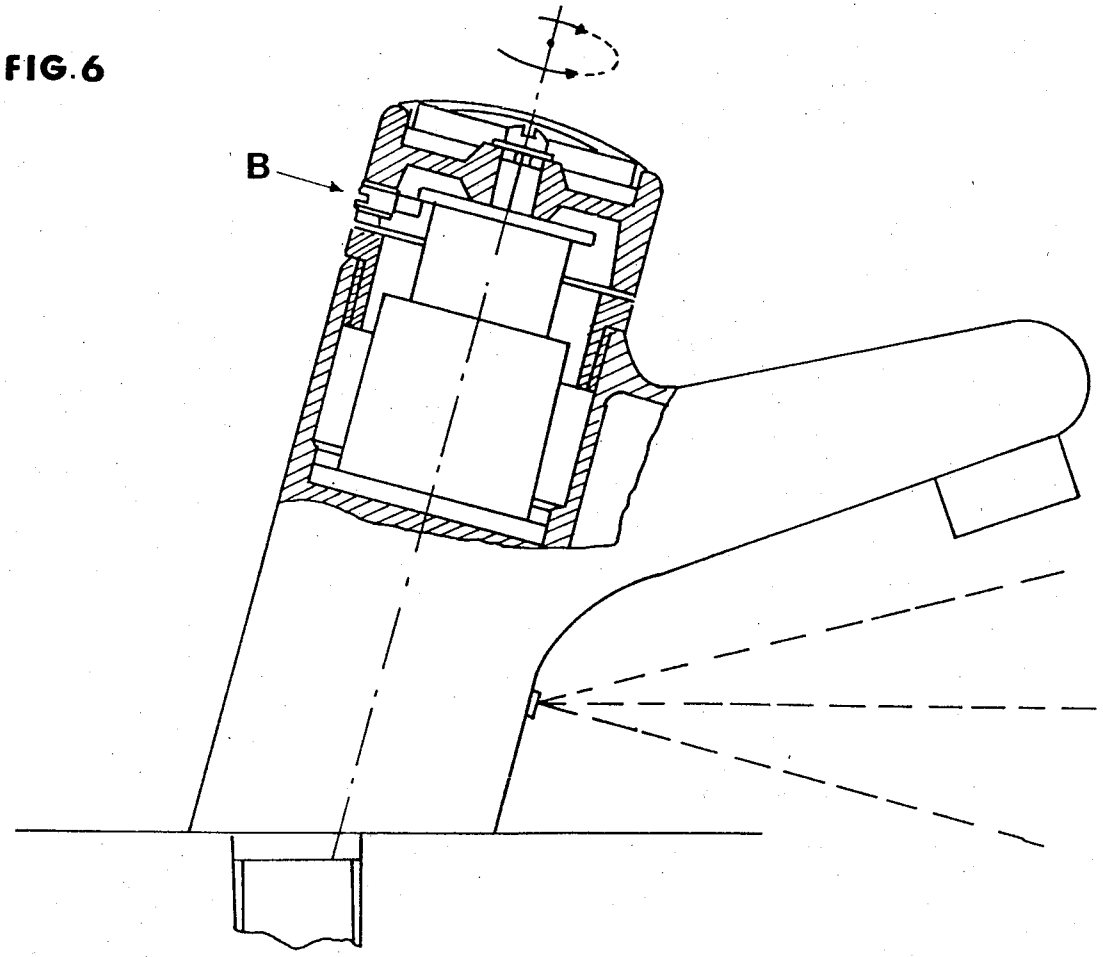
FIG. 6 depicts another tap in which a mixer is held by screw B in a position of rotation only and therefore of mixing only.
Figure 7:
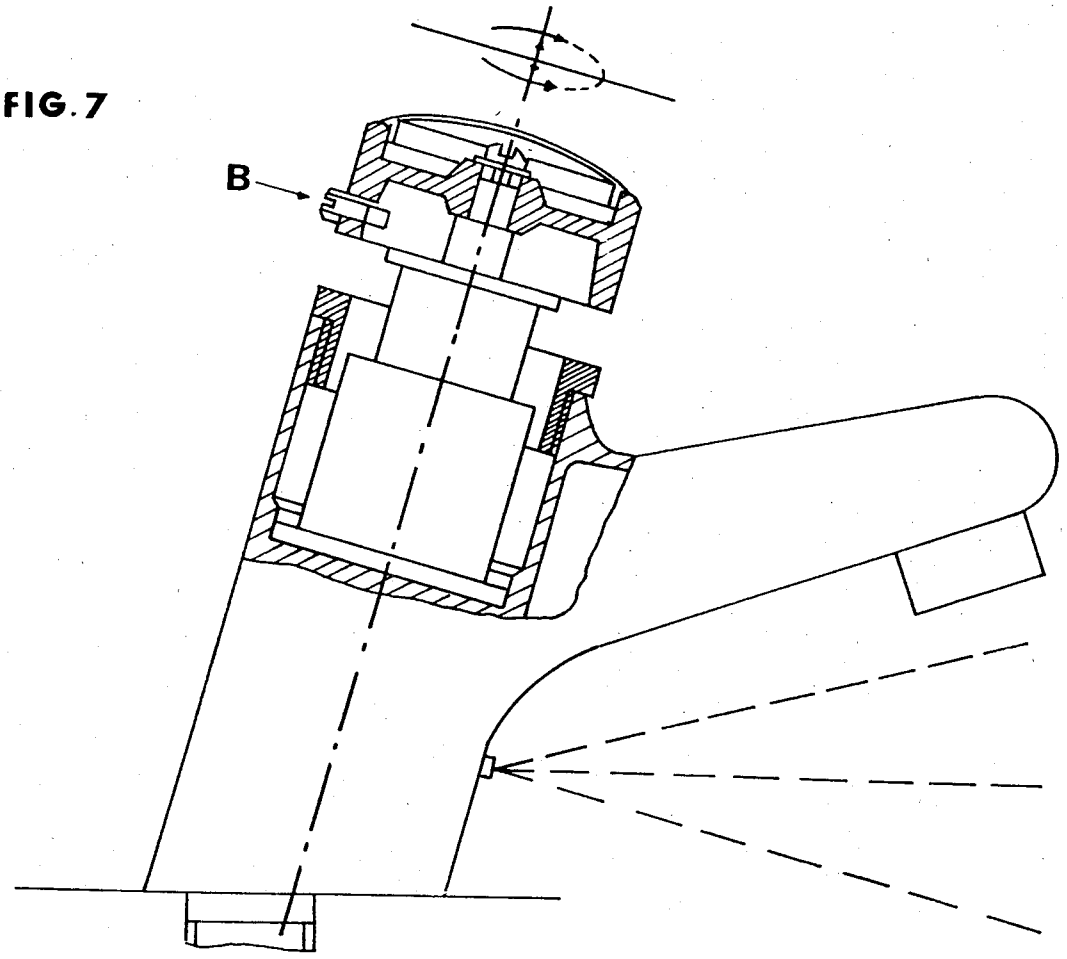
FIG. 7 depicts an embodiment for releasing the mixer by unscrewing screw B thus allowing the control lever of the mixer to be raised. Upward movement of the lever stops the flow of water as in a single control tap.

In the embodiment shown in FIG. 6, the tap normally functions automatically. The flow of water is started and stopped by the electronic valve. By keeping screw B tight, the upper handle rotates only and effects mixing of the water only. With reference to FIG. 7, by unscrewing screw B, the handle is permitted to rotate for mixing of the water, and in addition, the handle may be lifted for stopping the flow of water and lowered for initiating the flow of water through the faucet depicted in the Figure.

I claim:

1. A fluid delivery system, which can be alternately manually or automatically controlled, wherein the delivery system comprises:

a body for directing fluid to a desired location;

means for supplying fluid to the body;

regulator means for manually controlling flow of fluid through the body;

locking means for releasably locking the regulator means in an open position so that fluid can flow through the body;

electrically operated valve means in the fluid supply means, wherein the valve means is comprised of an automatically controlled fluid flow circuit and a manually controlled fluid flow circuit;

sensing means for detecting presence of an object proximate the body and for providing an electrical signal in response thereto;

controller means for opening and closing the valve;

means for transmitting the electrical signal to the controller for opening the automatically controlled fluid flow circuit in the valve;

wherein the locking means for the regulator is engaged when the manually controlled fluid flow circuit in the valve is closed, and the locking means is released when the manually controlled fluid flow circuit in the valve is open.

2. Fluid delivery system according to claim 1, wherein the automatically controlled fluid flow circuit and the manually controlled fluid flow circuit are separated by a flexible membrane, which closes the automatically controlled fluid flow circuit when the manually controlled fluid flow circuit is open.

3. Fluid delivery system according to claim 1, wherein the manually controlled fluid flow circuit is comprised of a conduit and a releasable screw means for blocking flow of fluid in the conduit.

4. Fluid delivery system according to claim 1, wherein the body is mounted on a basin and the body is positioned to direct fluid into the basin.

5. Fluid delivery system according to claim 1, wherein the regulator means is on the body.

6. Fluid delivery system according to claim 1, wherein the locking means is a set screw for preventing manual movement of the regulator.

7. Fluid delivery system according to claim 5, wherein the body includes means for mixing hot and cold fluid together.

8. Fluid delivery system according to claim 7, wherein the body includes a handle that is vertically movable to open and close the regulator to control flow of fluid through the body and horizontally movable to control temperature of fluid discharged from the body.

9. Fluid delivery system according to claim 8, wherein the handle is horizontally movable when the locking means is engaged, but vertical movement of the handle is prevented by the locking means.

10. Fluid delivery system according to claim 1, wherein the automatically controlled fluid flow circuit is disabled when the manually controlled fluid flow circuit is open.

* * * * *